US009704309B2

(12) United States Patent
Niemann et al.

(10) Patent No.: US 9,704,309 B2
(45) Date of Patent: Jul. 11, 2017

(54) METHOD FOR RECOGNISING AND CLASSIFYING DAMAGE INCIDENTS ON MOTOR VEHICLES AND A DEVICE FOR THE SAME

(71) Applicant: Hella KGaA Hueck & Co., Lippstadt (DE)

(72) Inventors: Thomas Niemann, Delmenhorst (DE); Klaas Hauke Baumgartel, Delmenhorst (DE); Karl-Ludwig Krieger, Brinkum (DE)

(73) Assignee: Hella KGAA Hueck & Co., Lippstadt (DE)

( * ) Notice: Subject to any disclaimer, the term of this patent is extended or adjusted under 35 U.S.C. 154(b) by 268 days.

(21) Appl. No.: 14/502,588

(22) Filed: Sep. 30, 2014

(65) Prior Publication Data

US 2015/0091718 A1 Apr. 2, 2015

(30) Foreign Application Priority Data

Sep. 30, 2013 (DE) ..... 10 2013 016 165
Apr. 30, 2014 (DE) ..... 10 2014 006 423

(51) Int. Cl.
*G07C 5/08* (2006.01)
*G08G 1/16* (2006.01)

(52) U.S. Cl.
CPC ..... *G07C 5/0833* (2013.01); *G07C 5/0816* (2013.01); *G08G 1/16* (2013.01); *G07C 5/085* (2013.01)

(58) Field of Classification Search
CPC ..... B60R 2021/01302; B60R 21/013; B60R 21/0132–21/0136; G07C 5/0816–5/0833; G07C 5/085; G08G 1/16
See application file for complete search history.

(56) References Cited

U.S. PATENT DOCUMENTS 5,265,831 A * 11/1993 Muller ..... B61L 1/06 246/124
5,629,864 A * 5/1997 Noe ..... G01R 31/3278 324/420
5,680,096 A * 10/1997 Grasmann ..... B60R 25/1004 340/426.27
5,748,075 A * 5/1998 Dirmeyer ..... B60R 16/037 180/274

(Continued)

FOREIGN PATENT DOCUMENTS

DE 19745309 4/1999
DE 10034542 1/2002

(Continued)

*Primary Examiner* — Orlando Bousono
(74) *Attorney, Agent, or Firm* — Muncy, Geissler, Olds & Lowe, P.C.

(57) ABSTRACT

A method for recognizing and classifying damage incidents and/or contact incidents, in particular on motor vehicles, the different forms of damage incident shall be detected, evaluated and classified by way of detecting and evaluating at least one impact sound signal. An amplitude envelope of the impact sound signal is determined and the impact sound signal is classified based on the time progression of the amplitude envelope. This involves assigning different damage incidents or contact incidents to different kinds of time progression of the amplitude envelope.

22 Claims, 3 Drawing Sheets

(56) References Cited

U.S. PATENT DOCUMENTS 6,595,544 B1* 7/2003 Hermann ..... B60R 21/013 180/274
2002/0063008 A1* 5/2002 Spies ..... B60R 13/04 180/274
2004/0144587 A1* 7/2004 Spies ..... B60R 13/04 180/274
2005/0161920 A1* 7/2005 Higuchi ..... B60R 21/0132 280/735
2006/0149449 A1* 7/2006 Baur ..... B60R 21/013 701/45
2008/0165621 A1* 7/2008 Fisher ..... F41H 13/00 367/118
2009/0019936 A1* 1/2009 Attia ..... G01H 3/08 73/659
2009/0276125 A1* 11/2009 Brandmeier ..... B60R 21/013 701/47
2010/0042296 A1* 2/2010 Brandmeier ..... B60R 21/0132 701/46
2010/0067324 A1* 3/2010 Preissler ..... G01S 7/52004 367/13
2010/0097597 A1* 4/2010 Andres ..... B60R 21/0136 356/4.06
2011/0071733 A1* 3/2011 Brandmeier ..... B60R 19/483 701/47
2011/0190989 A1* 8/2011 Feser ..... B60R 21/0132 701/46
2011/0209546 A1* 9/2011 Seuthe ..... B23Q 17/0976 73/579
2012/0121107 A1* 5/2012 Smykalla ..... B60R 21/0134 381/98

FOREIGN PATENT DOCUMENTS

DE 202008016237 3/2009
DE 102011006984 10/2012
GB 2226885 11/1990

* cited by examiner

METHOD FOR RECOGNISING AND CLASSIFYING DAMAGE INCIDENTS ON MOTOR VEHICLES AND A DEVICE FOR THE SAME

BACKGROUND OF THE INVENTION

Field of the Invention

The invention relates to a method for recognising and classifying damage incidents and/or contact incidents, in particular on motor vehicles, by detecting and evaluating at least one impact sound signal. Furthermore the invention relates to a device for performing the method, wherein the device comprises at least one impact sound sensor, which is connected with an evaluation unit for signal transfer. In addition the invention relates to a vehicle, in particular a motor vehicle comprising the above-mentioned device.

Brief Summary of the Related Art

Methods and devices for recognising damage incidents are known and are used, in particular, in the automobile field. The DE 100 34 542 for example discloses a method and a device for recognising the deformation of at least one structural part of a motor vehicle caused by an accident, by detecting an impact sound frequency spectrum. The impact sound frequency spectrum is passed to an evaluation unit as a sensor signal. At least one structural part is excited using a defined repeating frequency pulse, and the resulting impact sound frequency spectrum is detected and evaluated. This impact sound frequency spectrum is then compared with other impact sound frequency spectra resulting from the same frequency pulse and a significant difference is interpreted as being a deformation caused by an accident. No difference is made between types of accident. Further no provision is made for the detection of lesser damages such as scratches on the paintwork.

Structure-borne or impact sound sensors such as used in motor vehicles are predominantly designed for recognising collisions. Recognition of such major damage incidents by means of impact sound sensors is frequently utilised for protecting the occupants of the motor vehicle or other road users by triggering some form of protection. Usually an incident is evaluated by converting the detected impact sound signal, and this can be done, for example, by examining the energy of the impact sound signal or a spectrally resolved form of the impact sound signal. By comparing this with a previously determined threshold value it is for example possible, in case of a spectrally resolved impact sound signal, to make a decision as to whether for example an airbag shall be triggered or not triggered. A more detailed classification of the damage incident does not take place.

Therefore using the known methods it is not possible to decide whether the damage incident is for example a dent, a scratch on the paintwork or a major plastic deformation of the vehicle body. For a more accurate classification, i.e. for identifying the type of damage, an optical evaluation of the damage by means of a visual check, for example, is necessary. This is usually not possible while the vehicle is moving thus making it difficult to unequivocally assign the damage incident to a possible cause because of the time delay between incident and visual check.

SUMMARY OF THE INVENTION

The invention is based on the requirement to propose a method which is suitable for detecting, evaluating and classifying damage incidents and contact incidents on a motor vehicle.

The requirement is met by a method with the characteristics of patent claim 1, by a device with the characteristics of patent claim 16 and by a vehicle with the characteristics of patent claim 17. Further developments and advantageous arrangements are specified in the respective sub-claims.

The method for recognising and classifying damage incidents and/or contact incidents, in particular on motor vehicles, through detecting and evaluating at least one impact sound signal is characterised according to the invention in that an amplitude envelope of the impact sound signal is determined, and in that the impact sound signal is classified on the basis of the time progression of the amplitude envelope, wherein different kinds of time progression of the amplitude envelope are assigned to different damage incidents or contact incidents.

The analysis of the amplitude envelope makes it possible to perform an accurate evaluation of the time progression of an impact sound signal. Using the time progression of the amplitude envelope the impact sound signal can be further classified. Due to the fact that the signal is not translated into a frequency spectrum all time-dependent information of the signal is available. As such the curve of ascent, the decay curve, the time-dependent maximum amplitude as well as the signal length of the impact sound signal can be determined. These signal properties can be utilised for classifying the impact sound signal further.

The signal properties of the impact sound signal are calculated and stored as soon as at least one defined parameter is met by the impact sound signal or a signal arising from the impact sound signal. The impact sound signals arriving from the vehicle body or other structural parts of the motor vehicle are continuously monitored. As soon as one of these impact sound signals exceeds a previously defined threshold value, the algorithm for calculating and storing the signal properties is started. This permanent comparison of the impact sound signal with a threshold value represents a kind of pre-examination thereby obviating the need to perform a complete calculation of all signal properties for each impact sound signal. Due to this measure the time spent on calculations is much reduced.

Preferably frequencies of the impact sound signal which lie below a threshold frequency are dampened by means of a filter, in particular a high-pass filter. When a filtered signal exceeds a threshold value, the signal properties of the original and the filtered impact sound signals are starting to be calculated and stored. Due to filtering the entire impact sound signal by means of a high-pass filter, frequently occurring background noises such as engine vibrations, wheel running noises or similar, which lie mostly within a frequency range below the impact sound signal, are blanked out. Using the high-pass-filtered impact sound signal for comparison with a threshold value, which represents a sort of preliminary examination, allows the percentage of erroneous damage messages to be reduced. By dampening the lower frequencies, background noises from a lower frequency range contribute less to the spectrum of the impact sound signal.

The signal properties of the impact sound signal are evaluated by determining individual impact sound signal blocks which are consecutive in terms of time. By evaluating individual signal blocks which typically comprise a length of one to ten milliseconds, the computing power required for evaluation can be considerably reduced.

When the high-pass filtered signal exceeds a threshold value, the maximum amplitude and/or the mean value and/or the variance of the impact sound signal as well as the maximum amplitude of the high-pass filtered signal are calculated and stored. In addition the energy values of the impact sound signal and the energy values of the high-pass filtered impact sound signal are determined and stored. These stored signal details resolved over time are used to classify detected impact sound signals in more detail and thus to assign to them different damage incidents or contact incidents.

Storing of the impact sound signals continues until the signal energy level approaches a previously defined noise level or until there is no longer a significant change in the signal energy level of at least two consecutive signal blocks. As soon as the signal energy level is close to the previous noise level it is certain that the incident which has caused the change in the impact sound signal value has ended. There may also be incidents which cause a prolonged change in the signal energy level. Detection of such an incident is sure to be completed when there is no fundamental change in the signal energy level of at least two, preferably several consecutive signal blocks. The signal energy values have thus settled on a new value. When these criteria are met, evaluation and storage of the signal data is at an end.

A more accurate classification of the impact sound signals is effected by examining the time progression of the amplitude envelope of the impact sound signal. As such a pulse-like progression of the amplitude envelope is associated with a possible plastic deformation on the vehicle. A plastic deformation may for example be a dent in the vehicle body which was caused by a rock fall. A pulse-like progression of the amplitude envelope is characterised in that it comprises comparatively large amplitudes within a relatively short time window. This comes about, as for example with a rock fall, in that a lot of energy is transferred within a short period of time. As soon as the rock has bounced off, energy transfer is at an end, and the amplitude of the impact sound signal again approaches the normal value. It is also possible that due to a rock fall which leaves a dent in the motor vehicle the measured impact sound signal changes permanently.

In one embodiment of the method the pulse-like progression comprises high amplitude oscillations followed by an exponential drop. The high amplitude oscillations caused for example by a rock fall are characteristic of the pulse-like progression of an amplitude envelope of a plastic deformation. Due to the relatively short time of transferring the energy to the vehicle the amplitude envelope drops sharply, i.e. exponentially.

According to one embodiment of the method the elongated time progression of the amplitude envelope of the impact sound signal is assigned to a possible damage of the vehicle's paintwork. Damage to the paintwork of the vehicle, for example when the paintwork is scratched by brushwood, bushes or similar, is characterised in that the impact on the vehicle is prolonged causing an elongated impact sound signal. The transferred energy however is essentially less than with a plastic deformation by a stone or rock.

In one embodiment of the method the amplitude envelope comprises a first oscillation and a second oscillation spaced apart in terms of time, and the second oscillation is assigned to damage of the vehicle's paintwork. In case of damage to the vehicle's paintwork such as a scratch, a first amplitude maximum is, in most cases, caused by the object which causes the damage making contact. The damage to the paintwork as such results in a further oscillation of the amplitude envelope.

In one embodiment of the method the amplitude oscillations are of approximately the same magnitude in the elongated time progression. The section of the amplitude envelope reflecting the scratching of the paintwork as such is of an approximately constant magnitude because the impact of the force upon the vehicle paintwork during scratching is relatively constant.

An irregular time progression of the amplitude envelope of the impact sound signal is assigned to possible scrapings on the vehicle. Scrapings on the vehicle body, for example, occur when two vehicles touch each other during parking. The energy transferred to the vehicle body during a scraping is usually higher than when the paintwork is scratched. This means that scrapings leave traces on the vehicle body which are deeper.

With a pulse-like time progression of the amplitude envelope the impact sound signal is further examined in that the maximum amplitude of the impact sound signal is compared with a threshold value, and if the impact sound signal exceeds this threshold value, the energy value of the high-pass-filtered impact sound signal is compared with a further threshold value, and if this further threshold value is also exceeded, the decay time of the total energy of the impact sound signal is determined. If the decay time of the total energy of the impact sound signal is short, the impact sound signal is assigned to a plastic deformation. With a plastic deformation, for example of the vehicle body, a lot of energy is transferred to the structural part within a short time. This results in a large amplitude of the impact sound signal. The maximum amplitude of the impact sound signal is compared with a threshold value, wherein if this threshold value not reached, a plastic deformation of the vehicle is improbable, implying therefore that an elastic deformation has occurred.

If the threshold value is exceeded, then in a next step the energy of the high-pass-filtered signal is compared with a further threshold value. Comparing the energy value in the high-pass-filtered signal with a threshold value means that most of the energy in the impact sound signal does not occur at lower frequencies and is therefore caused, for example, by changes in the vehicle noises. If this threshold value is not reached, further signal properties must be checked for a more accurate classification of the damage incident. For example, a check may be performed to determine how much energy per time unit was transferred to the vehicle. If this threshold value is exceeded, then the decay time of the time progression of the total energy is examined. A short decay time allows the conclusion that a short-time pulse-like energy transfer onto the vehicle and thus a plastic deformation of the motor vehicle's body has occurred, for example.

In one embodiment of the method the amplitude envelope drops to 10% of the maximum within less than 0.4 seconds. If a plastic deformation has occurred the amplitude envelope decays within a time window of 0.4 seconds. Preferably a time window of 0.3 seconds is chosen, in which the amplitude envelope drops completely in order to assign the signal to a plastic deformation.

For an elongated progression of the amplitude envelope of the impact sound signal the signal is further examined in that the signal length of the impact sound signal is compared with a threshold value and if the threshold value is exceeded the energy value of the original impact sound signal is compared with the energy value of the high-pass-filtered impact sound signal. If the high-pass-filtered signal comprises a substantially higher energy value than the original impact sound signal it is probable that the paint has been scratched. Contacts between the motor vehicle, such as the vehicle body and an object or another motor vehicle which lead to the vehicle paint being scratched, are usually of a longer duration than contacts which for example lead to a plastic deformation of the vehicle. If the amplitude envelope of the impact sound signal has an elongated shape, but lies below the previously defined threshold value, a closer definition of this impact sound signal is difficult, and the signal is classified as being undefined. If, on the other hand, the signal length exceeds a threshold value, an examination is carried out as to whether the high-pass-filtered signal includes a higher energy than the original impact sound signal. In the high-pass-filtered signal, frequencies below a threshold frequency are dampened. Therefore a comparison between the energies of the high-pass-filtered signal and the original impact sound signal will reveal whether it is mainly the lower or mainly the higher frequencies which contribute to the total energy of the impact sound signal. Since a scratch on the paintwork usually causes higher frequencies to be emitted, it was probably this which caused the energy of the high-pass-filtered signal to exceed the energy of the original impact sound signal.

For an irregular time progression of the amplitude envelope, the signal length of the impact sound signal is compared with a threshold value, and if the threshold value is exceeded the total energy value of the impact sound signal is compared with a further threshold value. If this further threshold value is also exceeded, the impact sound signal is assigned to a scraping. A scraping, for example of a vehicle body, is usually preceded by a longer contact with another object or another vehicle. The signal length of the impact sound signal is therefore initially compared with a previously defined threshold value. If this threshold value is not reached, the impact sound signal is classified as an undefined noise. If this threshold value is exceeded, it is possible that the vehicle was scraped, and for further validation therefore the total energy value of the impact sound signal is compared with a, further threshold value. Since the energy transferred during a scraping is different from other contact incidents or damage incidents, it can be assumed, if this threshold value is exceeded, that a scraping has occurred. If this threshold value is not reached the noise is classified as undefined.

In a further embodiment of the method, for an elastic deformation, the amplitude envelope shows an exponential drop in relation to a starting value. The detected impact sound signal which is caused by an elastic deformation of for example the vehicle body, comprises an amplitude maximum which reflects the maximum indenting of the vehicle body. Since with an elastic deformation the vehicle body is not dented to an extent where the damage can be considered permanent, the amplitude maximum is not very pronounced.

In a further embodiment of the invention the exponential drop extends over a time period of at least 0.5 seconds. The decay time, i.e. the time period in which the signal has dropped to 10% of the maximum amplitude, is at least 0.5 seconds. Usually this lies within a time window of 0.5 to 1 second. The decay time of the elastic deformation is thus distinctly longer than with a plastic deformation.

In a further embodiment of the method the maximum amplitude of the amplitude envelope, for a plastic deformation, is usually greater than for an elastic deformation. The impact sound signal of a plastic deformation can be distinguished from that of an elastic deformation in that its amplitude maximum is greater. For a plastic deformation the amplitude maximum is greater because of the higher energy input. For an accurate assessment a threshold value may be introduced which, when it is exceeded, indicates a plastic deformation.

In a further development of the method the association of the impact sound signals with different damage incidents or contact incidents can be further validated through the use of e.g. artificial neuronal networks, hidden Markov models or other voice recognition methods. Due to these methods the impact sound signals can be sampled and processed more accurately and can thus be more accurately assigned to different damage incidents or contact incidents. As such different frequency progressions or different frequency sequences can be examined. Further, the signals can be broken down and compared with stored pieces of comparison, in order to determine possible matches. In addition artificial networks can e.g. be trained by a defined training data set.

Advantageously the impact sound signals of at least one metallic surface, in particular of an outer envelope of a vehicle, can be detected and evaluated. Detecting impact sound signals of the outer envelope of the vehicle allows contact incidents or damage incidents to be detected. The impact sound triggered by a damage incident is transferred via the outer envelope to the entire vehicle or the body of the vehicle and therefore can be easily detected by suitable sensors.

A further aspect of the invention relates to a device for performing the method according to the invention, wherein the device comprises at least one impact sound sensor connected with an evaluation unit in a signal-transferring manner. The device is characterised in that the evaluation unit comprises a unit for calculating an amplitude envelope and a unit for the time-dependent analysis of an amplitude envelope or impact sound signal and in that the device comprises a unit for filtering an impact sound signal and in that the device comprises an incident storing unit.

Preferably several impact sound sensors are arranged for example on the body of the motor vehicle. Any occurring contact incidents or damage incidents can therefore be detected at any point of the vehicle body. The impact sound sensors are connected with an evaluation unit, wherein each impact sound sensor may be connected with an evaluation unit, or wherein the motor vehicle comprises a central evaluation unit which has all impact sound sensors connected with it. All computing operations required for detection and classification are performed in the evaluation unit.

In addition the invention relates to a vehicle, in particular a motor vehicle, with a device according to the invention. With a motor vehicle the impact sound sensors and the evaluation unit can be integrated with already existing sensors or computing units.

BRIEF DESCRIPTION OF THE DRAWINGS

The invention will now be explained further by way of embodiments shown in the drawing, in which.

DETAILED DESCRIPTION OF THE PREFERRED EMBODIMENTS

Figure 1:
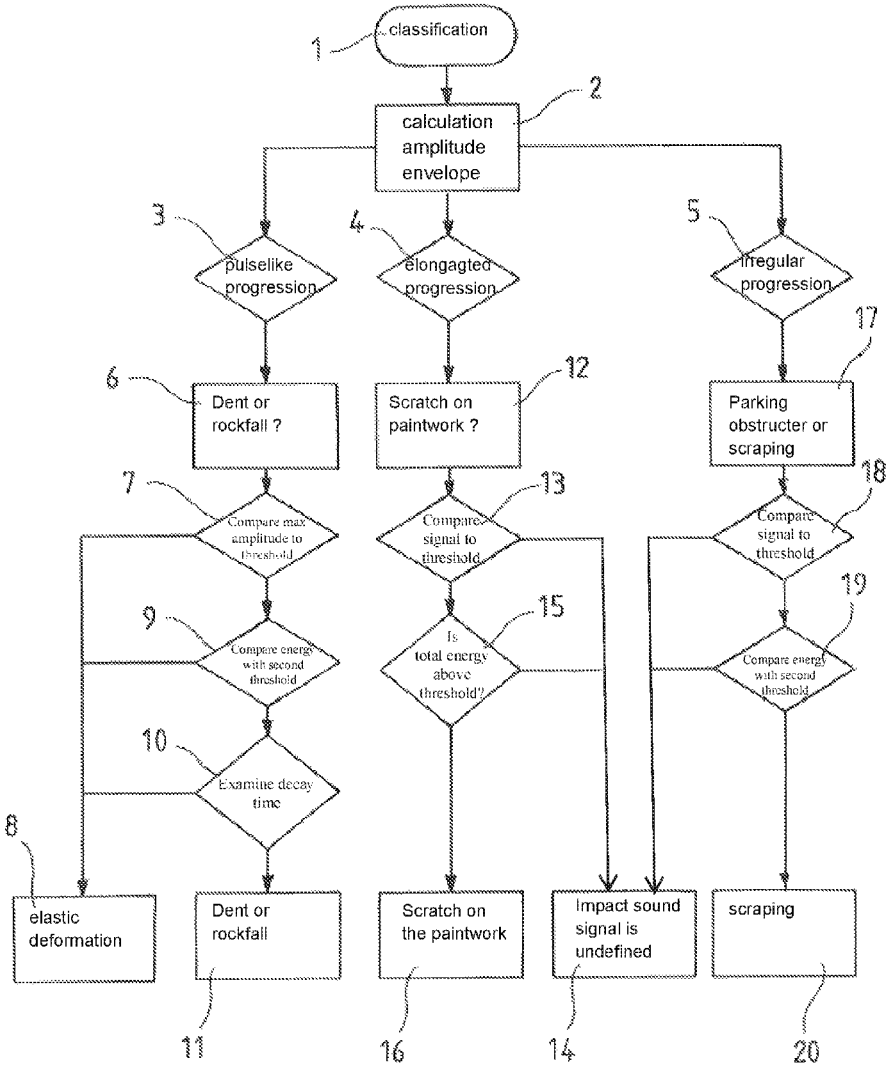
FIG. 1 shows a schematic representation of the method.

The impact sound signal permanently registered by the impact sound sensors is initially filtered using a high-pass filter in order to blank out background noises such as engine vibrations or wheel-running noises. The high-pass-filtered signal is compared with a threshold value and as soon as this previously defined threshold value is exceeded, the signal properties of the original impact sound signal and the high-pass-filtered impact sound signal are starting to be calculated and stored. Of the original impact sound signal, the maximum amplitude, the mean value and the variance are determined. Of the high-pass-filtered impact sound signal, the maximum amplitude is determined. In addition the energy values of the high-pass-filtered and the original impact sound signal are calculated. Recording these values ends as soon as the signal energy level approaches a previous noise level or as soon as the values have settled on a new fixed value. After calculation and storage of the impact sound signals caused by a damage or contact incident, classification 1 as such begins. Initially the amplitude envelope of the impact sound signal is calculated 2 and its time progression is examined. In the process a difference is made between a pulse-like 3 progression, an elongated progression 4 and an irregular progression 5. If the amplitude envelope comprises a pulse-like progression 3, this could indicate 6 a dent or a rock fall. For closer examination in a first step 7, the maximum amplitude of the impact sound signal is compared with a threshold value. If the maximum amplitude comprises a value which is smaller than the value previously defined, it is probable that an elastic deformation 8 has occurred. If the maximum amplitude comprises a higher threshold value, then in a second step 9, the energy of the high-pass-filtered impact sound signal is compared with a second threshold value. A drop below this threshold value is assigned to an elastic deformation 8, and if the threshold value is exceeded in a third step 10, the decay time of the total energy of the impact sound signal is examined. For a short decay time of the total energy the damage or contact incident is assigned to a dent or a rock fall 11.

For an elongated progression 4 of the amplitude envelope a scratch on the paintwork 12 could be the cause for this impact sound signal. To this end, in a first step 13, the signal length of the impact sound signal is compared with a previously defined threshold value. If the length of this signal falls short of the threshold value, the cause of the impact sound signal is undefined 14. If the signal length exceeds the threshold value, then in a further examination 15, an assessment is made whether a major part of the total energy of the impact sound signal lies within the frequency range above the threshold frequency of the high-pass filter. If this is not the case the signal is assigned to an undefined noise 14. If the higher frequency range comprises a distinctly higher energy percentage than the lower frequency range, it is probable that the cause of the impact sound signal 16 is a scratch on the paintwork.

For an irregular progression of the amplitude envelope the cause for the signal may be a parking obstructer or a scraping 17. In the examination, in a first step 18, the signal length is compared with a threshold value. If the threshold value is not reached the incident is assigned an undefined noise 14. If the signal length exceeds the previously defined threshold value, the total energy of the impact sound signal is compared, in a further step 19, with a further threshold value. If the threshold value is not reached the signal is assigned an undefined noise 14. If the value of the total energy exceeds the threshold value, it is probable that a scraping 20 is the cause for the impact sound signal.

Figure 2:
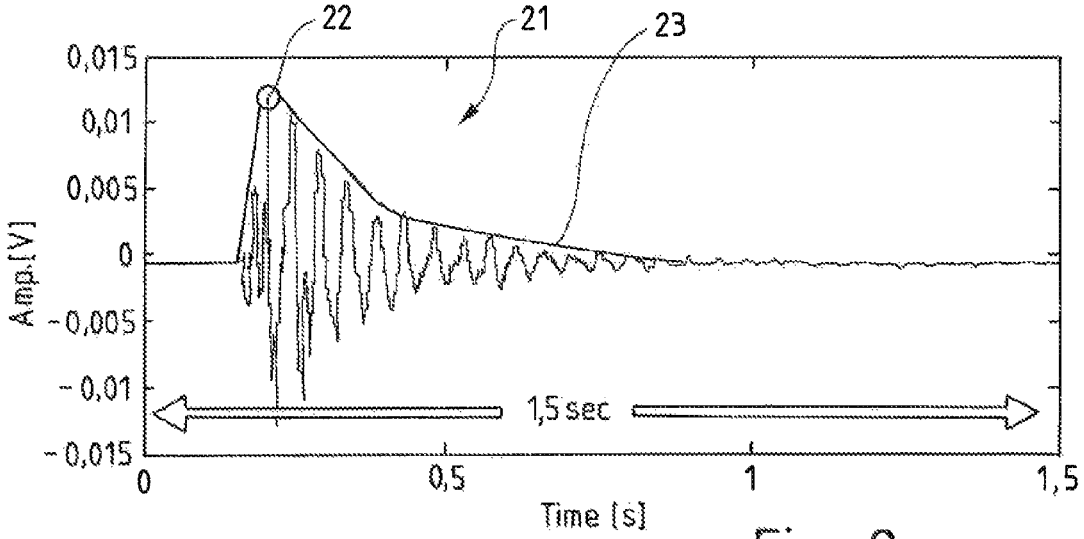
FIG. 2 shows a schematic representation of a measurement signal of an elastic deformation.

FIG. 2 shows the impact sound signal of an elastic deformation 21. Starting from an amplitude maximum 22, which in this example comprises a value of approx. 13 mV, the amplitude envelope drops exponentially 23. The decay time in which the signal drops to 10% of the amplitude maximum, is approx. 0.6 seconds. Since the energy input during the elastic deformation is not very great, this leaves no damage on the vehicle.

Figure 3:
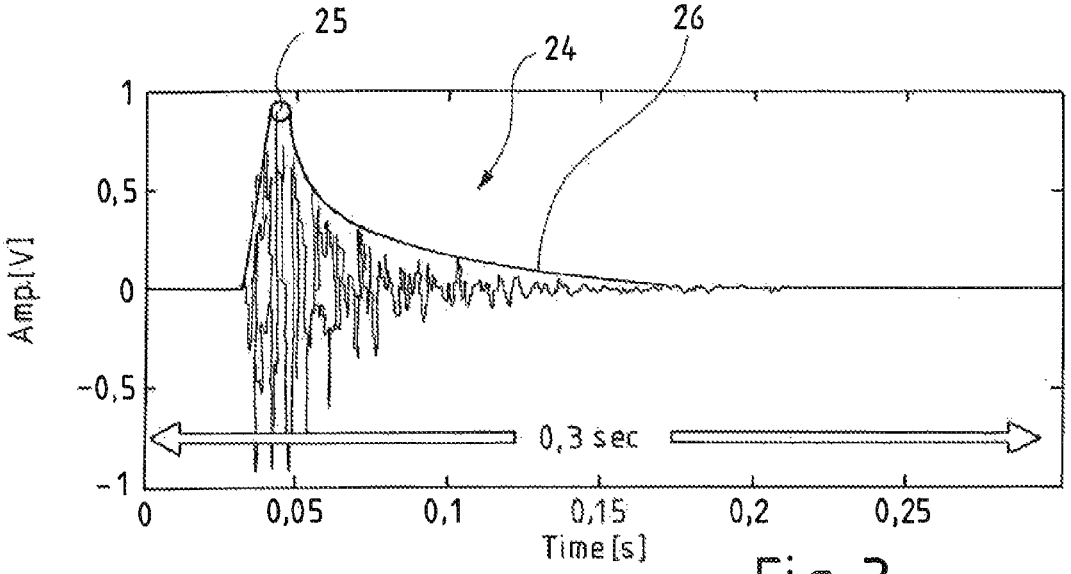
FIG. 3 shows a schematic representation of a signal of a plastic deformation.

FIG. 3 shows the schematic progression of the impact sound signal of a plastic deformation 24 on the outer envelope of the vehicle. Starting from an amplitude maximum 25 of 950 mV the amplitude envelope drops exponentially 26. The decay time of the plastic deformation in this example is 125 milliseconds. Compared to an elastic deformation the plastic deformation therefore comprises a substantially higher amplitude maximum 25 and a substantially shorter decay time. The substantially greater amplitude maximum 25 is due to the higher energy which is transferred to the vehicle outer envelope during the plastic deformation.

Figure 4:
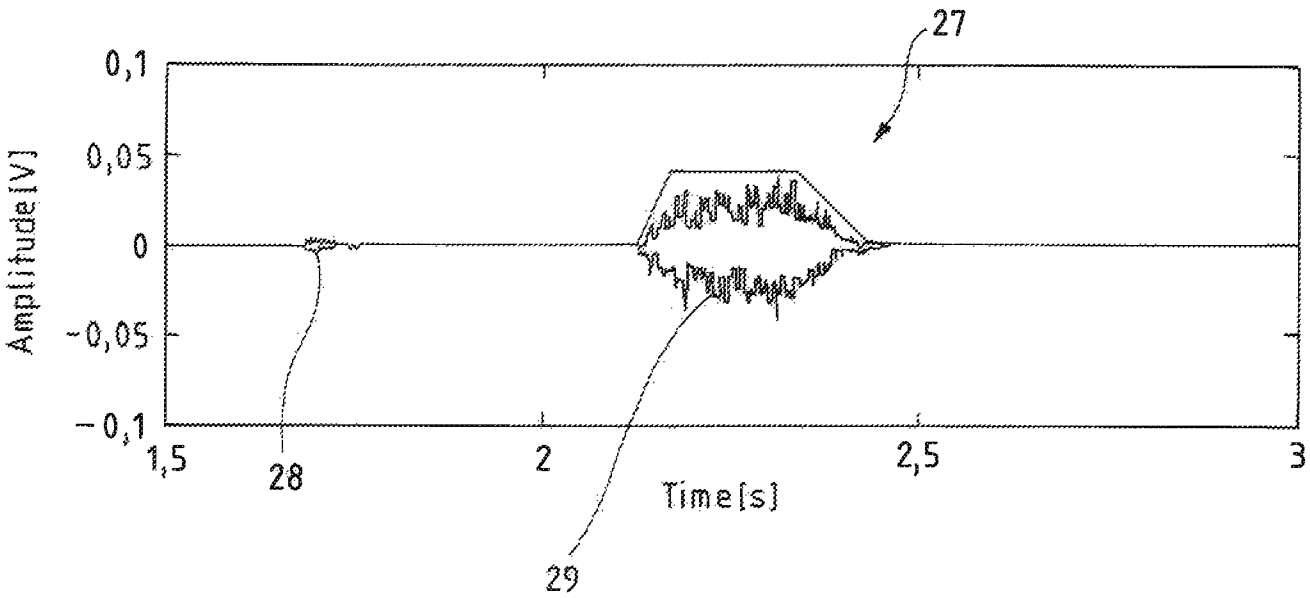
FIG. 4 shows a schematic representation of a signal indicating damage to the paintwork of the vehicle.

FIG. 4 schematically shows the impact sound signal for a scratch on the vehicle paintwork 27. The graph shows two oscillations of the amplitude envelope spaced apart over time. The first oscillation 28 of the amplitude envelope comprises an essentially smaller amplitude maximum than the second oscillation 29. The first oscillation 28 of the amplitude envelope is assigned to the contact-making of the object causing the scratch on the paintwork. The second larger oscillation 29 of the amplitude envelope is assigned to the scratch on the paintwork. This signal section 29 comprises an elongated progression, wherein the amplitudes of the amplitude envelope are of approximately equal magnitude.

All features cited in the above description and in the claims can be selectively, at random, combined with the features of the independent claim. The disclosure of the invention is therefore not limited to the described or claimed feature combinations, rather all feature combinations in terms of the invention are to be regarded as having been disclosed.

The invention claimed is:

1. A method for recognizing and classifying damage incidents and/or contact incidents on a motor vehicle by detecting and evaluating at least one impact sound signal, wherein an amplitude envelope of the at least one impact sound signal, having multiple frequencies, is determined and the amplitude envelope of the at least one impact sound signal is classified based on the time progression of the amplitude envelope of the at least one impact sound signal, wherein different damage incidents or contact incidents are assigned to different kinds of time progression of the amplitude envelope of the at least one impact sound signal, wherein calculating and storing signal properties of the at least one impact sound signal starts as soon as at least one defined parameter is met by either the at least one impact sound signal or a signal arising from the at least one impact sound signal, and wherein the multiple frequencies of the at least one impact sound signal which lie below a threshold frequency are dampened using a high-pass filter, and in that if the at least one high-pass-filtered impact sound signal exceeds a threshold value, the signal properties of the at least one impact sound signal and signal properties of the at least one high-pass-filtered impact sound signals are calculated and stored.

2. The method according to claim 1, wherein the signal properties of the at least one impact sound signal are determined from individual consecutive impact sound signal blocks in terms of time.

3. The method according to claim 1, wherein a maximum amplitude of the at least one high-pass-filtered impact sound signal and at least one of a maximum amplitude and/or a mean value and/or a variance of the at least one impact sound signal are calculated and stored.

4. The method according to claim 3, wherein energy values of the at least one impact sound signal and energy values of the at least one high-pass-filtered impact sound signal are determined and stored.

5. The method according to claim 2, wherein storing of the signal properties of the at least one impact sound signal is continued until a signal energy level of the at least one impact sound signal approaches a previously defined noise level or until there is no change in a signal energy level of two consecutive blocks of the at least one impact sound signal in terms of time.

6. The method according to claim 5, wherein a pulse-like time progression of the amplitude envelope of the at least one impact sound signal is assigned to a possible plastic deformation on the motor vehicle.

7. The method according to claim 6, wherein the pulse-like time progression comprises a high amplitude oscillation followed by an exponential drop.

8. The method according to claim 5, wherein an elongated time progression of the amplitude envelope of the at least one impact sound signal is assigned to a possible damage of a paintwork of the motor vehicle.

9. The method according to claim 8, wherein the amplitude envelope of the at least one impact sound signal comprises a first oscillation and a second oscillation spaced apart in terms of time, and in that the second oscillation is assigned to a damage of a paintwork of the motor vehicle.

10. The method according to claim 9, wherein the first and second oscillations of the amplitude envelope of the at least one impact sound signal are of a same magnitude.

11. The method according to claim 5, wherein an irregular time progression of the amplitude envelope of the at least one impact sound signal is assigned to a possible scraping on the motor vehicle.

12. The method according to claim 6, wherein a maximum amplitude of the at least one impact sound signal is compared with the threshold value and in that, if the at least one impact sound signal exceeds the threshold value, a signal energy level of the at least one high-pass-filtered impact sound signal is compared with a further threshold value, and in that, if the further threshold value is exceeded, a decay time of a total energy of the at least one impact sound signal is determined and in that, for a short decay time, the at least one impact sound signal is assigned to the possible plastic deformation.

13. The method according to claim 12, wherein the amplitude envelope of the at least one impact sound signal drops to 10% of the maximum amplitude of the at least one impact sound signal in less than 0.4 seconds.

14. The method according to claim 9, wherein a signal length of the at least one impact sound signal is compared with the threshold value and in that, if the threshold value is exceeded, an energy value of the at least one impact sound signal is compared with a signal energy level of the at least one high-pass-filtered impact sound signal and in that, if the at least one high-pass-filtered impact sound signal comprises a higher signal energy level, the at least one impact sound signal is assigned to a scratch on the paintwork of the motor vehicle.

15. The method according to claim 11, wherein a signal length of the at least one impact sound signal is compared with a signal length threshold value and in that, if the signal length threshold value is exceeded, a total energy value of the at least one impact sound signal is compared with a further threshold value and in that, if this further threshold value is exceeded, the at least one impact sound signal is assigned to a scraping on the motor vehicle.

16. The method according to claim 1, wherein for an elastic deformation the amplitude envelope of the at least one impact sound signal, starting from a starting value, comprises an exponential drop.

17. The method according to claim 16, wherein the exponential drop extends over a time period of at least 0.5 seconds.

18. The method according to claim 17, wherein a maximum amplitude of the amplitude envelope of the at least one impact sound signal for a plastic deformation is greater than for an elastic deformation.

19. The method according to claim 15, wherein assignment of the at least one impact sound signal to different damage incidents or contact incidents is further validated through the use of artificial neuronal networks, hidden Markov models or voice recognition methods.

20. The method according to claim 19, wherein the at least one impact sound signal of at least one metallic surface, in particular an outer envelope of the motor vehicle, is detected and evaluated.

21. A device for performing the method according to claim 1, wherein the device comprises at least one impact sound sensor connected with an evaluation unit in a signal-transferring manner and a storage unit, wherein the evaluation unit comprises a unit for calculating the amplitude envelope of the at least one impact sound signal and a unit for the time-dependent analysis of the amplitude envelope of the at least one impact sound signal, and wherein the device comprises a unit for filtering the at least one impact sound signal.

22. A vehicle, in particular a motor vehicle, with a device according to claim 21.

* * * * *